US006763610B2

(12) United States Patent
Issler

(10) Patent No.: US 6,763,610 B2
(45) Date of Patent: Jul. 20, 2004

(54) STITCH AND TURN FOOTWEAR CONSTRUCTION

(75) Inventor: James E. Issler, Greenwich, CT (US)

(73) Assignee: Columbia Insurance Co., Omaha, NE (US)

( * ) Notice: Subject to any disclaimer, the term of this patent is extended or adjusted under 35 U.S.C. 154(b) by 0 days.

(21) Appl. No.: 09/862,529

(22) Filed: May 22, 2001

(65) Prior Publication Data

US 2002/0174566 A1 Nov. 28, 2002

(51) Int. Cl.[7] ..... A43B 9/02; A43B 13/28
(52) U.S. Cl. ..... 36/17 A; 36/19 R; 36/12
(58) Field of Search ..... 36/12, 17 A, 18, 36/19 R, 19 A, 22 R

(56) References Cited

U.S. PATENT DOCUMENTS 939,624 A * 11/1909 Pierce
1,039,442 A * 9/1912 Redman
1,578,890 A * 3/1926 Hayden
1,604,462 A * 10/1926 McHugh et al.
1,611,984 A * 12/1926 Arlidge
1,714,691 A * 5/1929 Nugent
1,809,247 A * 6/1931 Melchionna
1,871,547 A * 8/1932 Melchionna
1,924,542 A * 8/1933 De Liso
1,926,656 A * 9/1933 Shimkowitz
2,614,342 A * 10/1952 Hoza
3,152,407 A * 10/1964 Richards
5,146,697 A * 9/1992 Weiss
5,203,792 A * 4/1993 Kaiser
5,784,736 A * 7/1998 Issler et al.

* cited by examiner

*Primary Examiner*—M. D. Patterson
(74) *Attorney, Agent, or Firm*—St. Onge Steward Johnston & Reens, LLC

(57) ABSTRACT

A method of constructing a footwear includes the following features. An outsole having a backpart and a forepart is provided. The forepart has a standing lip around the periphery of the forepart. An upper is provided, which together with the outsole defines a volume for receiving a wearer's foot. The upper is turned inside out and then the upper is stitched to the lip of the forepart. The upper stitched to the forepart is then turned inside in. A back portion of the upper is lasted. The backpart is then secured to the lasted back portion of the upper.

5 Claims, 12 Drawing Sheets

STITCH AND TURN FOOTWEAR CONSTRUCTION

BACKGROUND OF THE INVENTION

The invention relates to footwear.

There are a wide variety of ways of constructing a shoe. The construction of a shoe generally refers to the manner in which the upper and the sole are attached. One of the most popular shoe ways of making a shoe is the cemented shoe construction. With a cemented shoe construction, the upper is lasted over an insole with the outsole then cemented thereto. A heel may also be attached to the outsole. This construction is relatively durable while providing a sleek appearance.

SUMMARY OF THE INVENTION

The invention relates to a footwear having an upper and an outsole which are attached inside out and then turned inside in. In a general aspect of the invention, a method of constructing includes the following steps. An outsole having a backpart and a forepart is provided. The forepart has a standing lip around the periphery of the forepart. An upper is provided, which together with the outsole defines a volume for receiving a wearer's foot. The upper is turned "inside out" and then the upper is stitched to the lip of the forepart. The upper stitched to the forepart is then turned "inside in." A back portion of the upper is lasted. The backpart is then secured to the lasted back portion of the upper.

Embodiments of this aspect of the invention may include one or more of the following features. The forepart of the outsole is attached to the upper. For example, the periphery of the forepart is stitched from a first end of the lip to a second end, and is stitched from a first marker at a side of a front portion of the upper to a second marker at the opposite side of the front portion of the upper, to attach the forepart of the outsole to the upper.

The outsole including the forepart and the backpart can be formed as one integral unit or as two separate pieces. If the outsole is one integral piece, the backpart can be folded over to the forepart and the backpart can be held at this position by an elastic retaining band to last the back portion of the upper. If the outsole is two pieces, the forepart can have a protrusion and the backpart can have a channel for accommodating the protrusion. After lasting the back portion of the upper, the protrusion of the forepart can be attached to the channel of the backpart.

In another general aspect of the invention, a footwear includes the following members and features. An outsole has a backpart and a forepart. The forepart has a standing lip with vertical grooves around the periphery of the forepart. An upper cooperates with the outsole to define a volume for receiving a wearer's foot. The upper and the forepart are joined by turning the upper inside out and stitching the upper to the lip of the forepart. The upper stitched to the forepart is then turned inside in. A last with a tuckboard attached thereon is inserted into the volume defined by the upper and the outsole. A back portion of the upper is lasted and the backpart secured to the lasted back portion of the upper. A front portion of the upper has an allowance of about 7 mm for turning and stitching.

The upper and the outsole are stitched at the periphery of the forepart, from one end of the lip to the other end, and stitched from a first marker at a side of a front portion of the upper to a second marker at the opposite side of the front portion of the upper.

Embodiments of this aspect of the invention may include one or more of the following features. A forepart filler is inserted into a cavity defined by the lip of the forepart. A tuckboard is disposed on top of the forepart filler and a footbed is disposed on top of the tuckboard.

Among other advantages, because this shoe construction does not require an insole, a shoe having added flexibility and reduced weight is provided. Such a shoe provides greater comfort while maintaining the sleek appearance of a cement lasted shoe. That is, shoes made with this construction are extremely flexible in the stitch and turn front portion and yet have the appearance of conventional shoes in the back part. With this construction, light weight dress shoes can be produced without sacrificing flexibility and softness.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

FIG. 5 shows the upper and the outsole unit of FIG. 4 turned inside in.

FIG. 10 shows the upper and the forepart of FIG. 9 turned inside in.

Like reference symbols in the various drawings indicate like elements.

DESCRIPTION OF THE PREFERRED EMBODIMENTS

Figure 1:
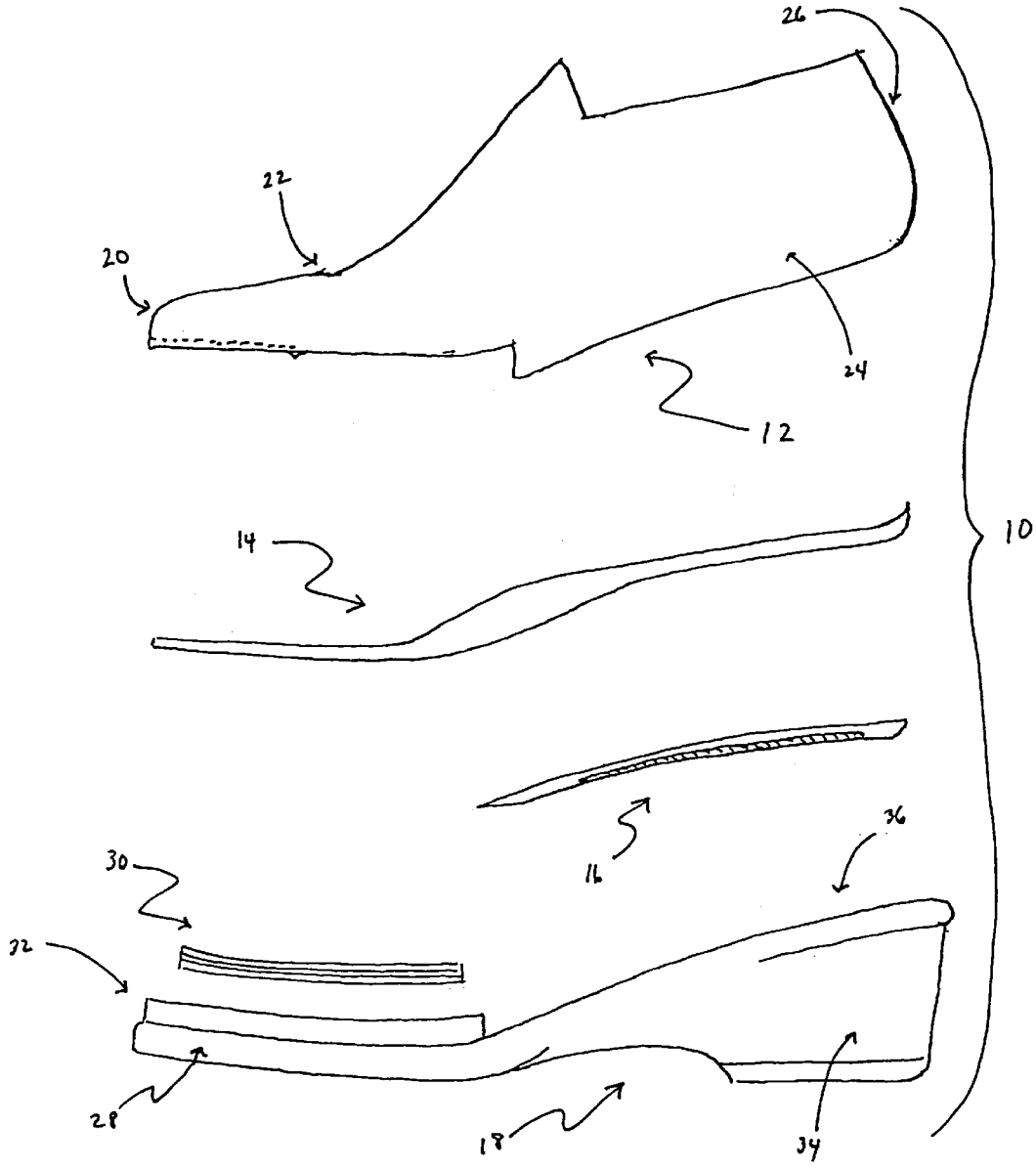
FIG. 1 is an exploded side view of the component parts of a shoe constructed in accordance with the invention.

FIG. 1 shows a shoe 10 that includes an upper 12, a footbed 14, a tuckboard 16, and an outsole unit 18.

The upper 12, preferably made of leather, cooperates with the outsole unit 18 to form an internal volume of the shoe 10. The upper 12 includes an inner liner (not shown) that is sewn to the inner surface of the upper 12. The inner liner is preferably made of soft leather to provide comfort to the wearer. The upper 12 also includes a heat activated toe stiffener fitted and stitched inside a tip region 20 of the upper. The upper 12 is divided into a front portion 22 and a back portion 24. The front portion 22 includes the tip region 20 and extends back to about half the length of the upper, approximately where the arch of the wearer's foot would be located. The back portion 24 is the other half of the upper 12 and includes a lasting edge 26, which is lasted with a last (not shown) to give form to the back portion.

The outsole unit 18 includes an outsole 28, divided into a forepart 32 and a backpart 36 and preferably made of molded polyvinyl chloride, and a forepart filler 30, which is fitted into the forepart 32 of the outsole. A heel 34 is molded together with the outsole 28. The tuckboard 16 and the footbed 14 are disposed on top of the outsole unit 18.

Figure 2:
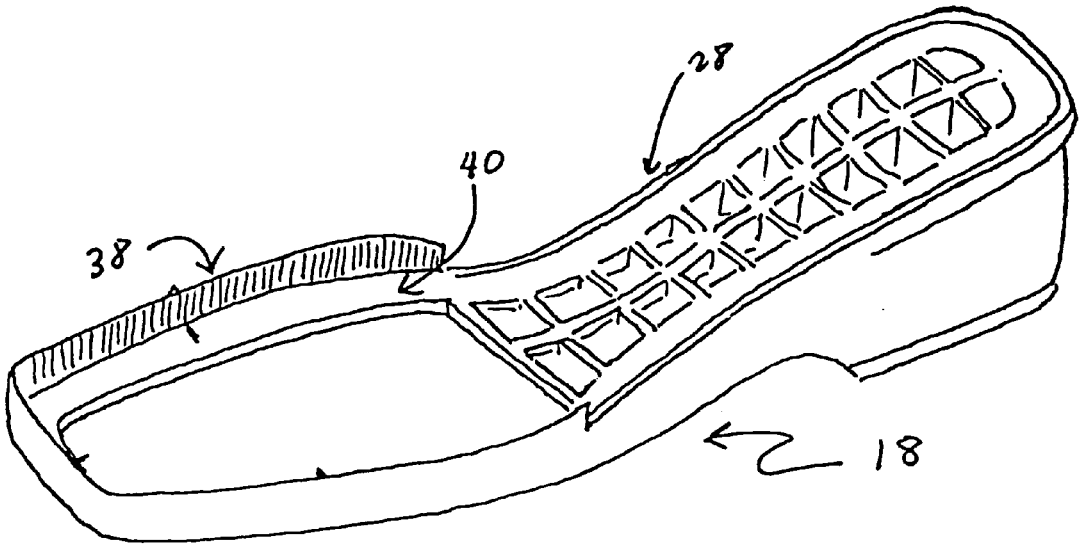
FIG. 2 shows an outsole unit of the shoe of FIG. 1.

Referring to FIG. 2, the outsole 28 has a standing lip 38 at the periphery of the forepart 32. The standing lip 38 has vertical grooves and stands approximately 7 mm from an adjacent pre-roughed base 40, which promotes adhesion of the vertically grooved lip to the base when the upper 12 is stitched to the outsole unit 18. The stitching process will be described in greater detail later. The standing lip 38 and the base 40 define a cavity into which the forepart filler 30 is to be fitted.

Figure 3A:
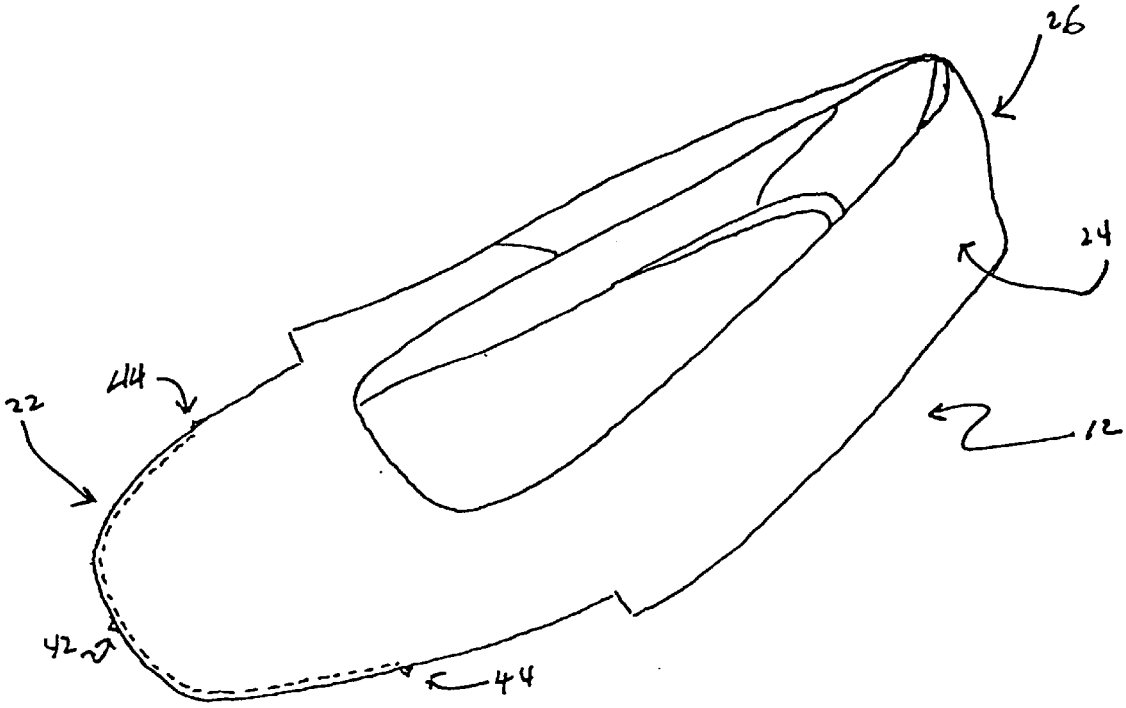
FIGS. 3A and 3B shows an upper of the shoe of FIG. 1
Figure 3B:
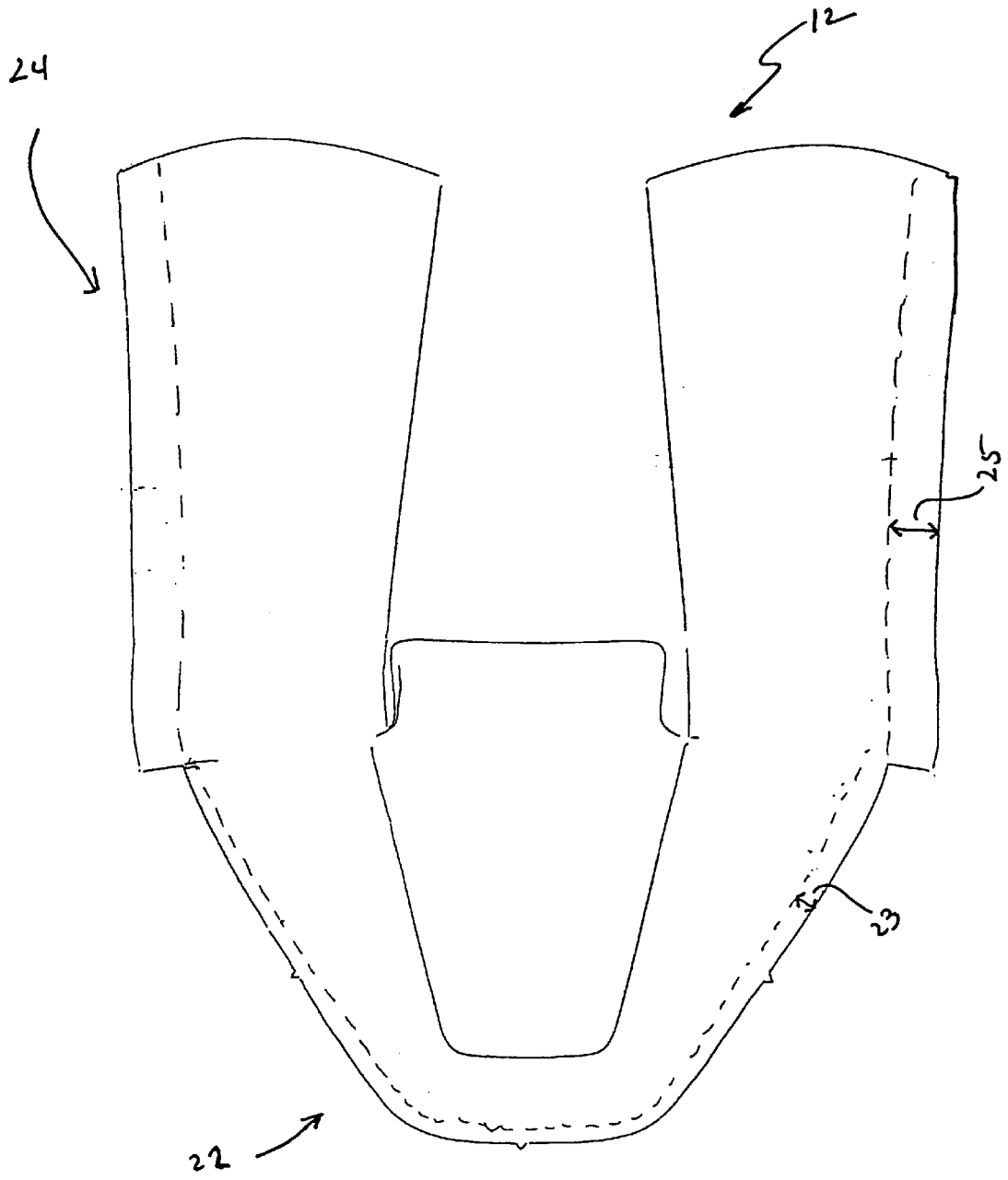

Referring to FIG. 3A, the upper 12 is shown to have a center mark 42 at the tip region 20 and two side marks 44 at the sides of the front portion 22 for guiding the stitching process. Referring to FIG. 3B, the front portion 22 of the upper 12 has a predetermined allowance 23, approximately 7 mm, for allowing the upper 12 and the outsole 28 to be stitched together inside out and then turned inside in after they are stitched together. The back portion 24 also has a predetermined allowance 25, approximately 15 mm, for allowing the lasting edge 26 to be lasted.

A construction method of the shoe 10 will be described in connection with the figures.

Figure 4:
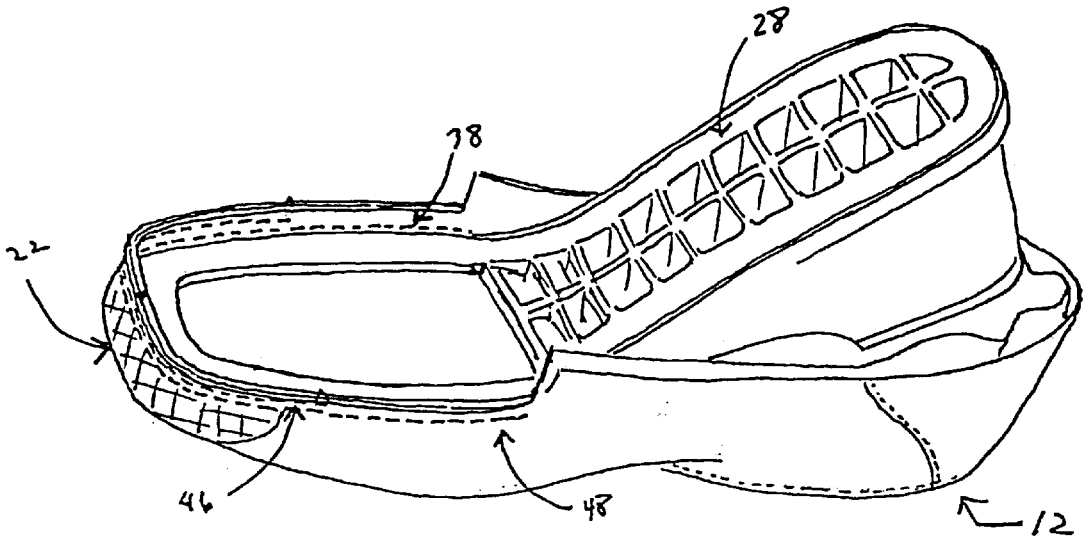
FIG. 4 shows an upper and an outsole unit attached inside out.

Referring to FIG. 4, the upper 12 is turned inside out and attached to the outsole 28 with the heel side facing the upper. The periphery of the front portion 22 of the upper is stitched to the standing lip 38 of the outsole. One row of stitching 46 is made from one side marker 44 to the other side marker 44, going around the periphery of the forepart 32 of the outsole 28. An additional row of stitching 48 is made from one lip end to the other lip end. The stitched lip 38 is then attached to the base 40.

Figure 5:
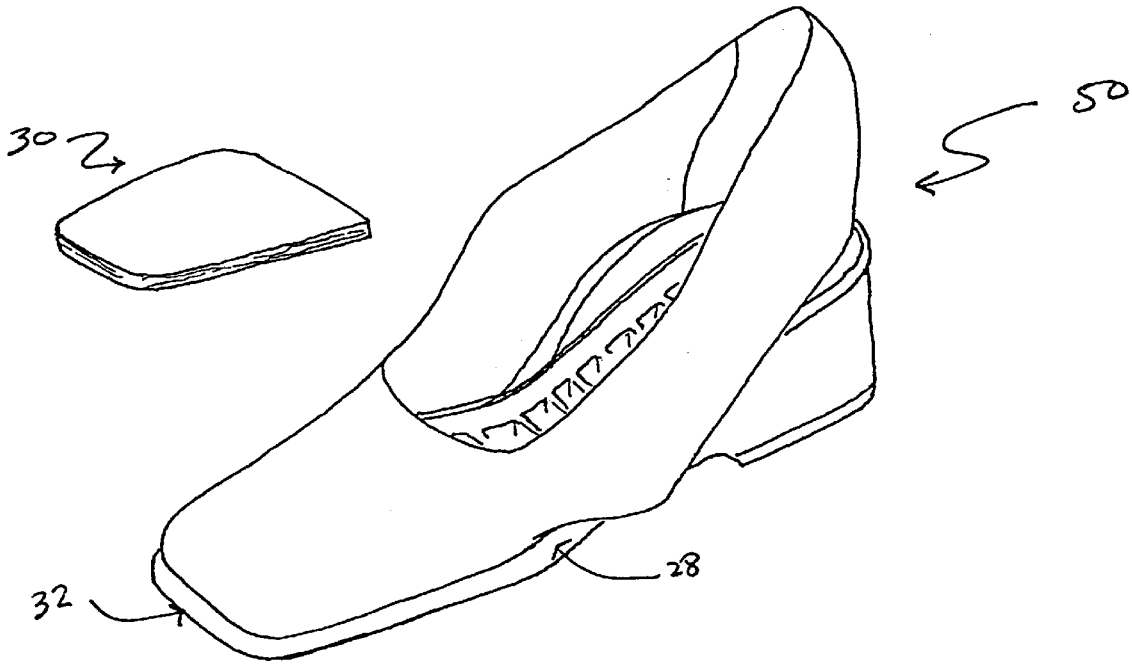

After the upper 12 is stitched to the outsole 28, the inside out configuration is turned inside in to obtain a turned upper configuration 50 as shown in FIG. 5. The forepart filler 30 is then inserted inside the turned upper configuration 50 and placed at the cavity of the forepart 32. The forepart filler 30 is preferably made of layers of "dry2," cork and EVA copolymer, sold under the tradename Elvax by E.I duPont de Nemours, Wilmington, Del.

Although not shown, a counter stiffener can be inserted into the upper 12 to provide structural support to the heel portion of the turned upper configuration 50. The counter stiffener is generally made of a thermoplastic material on a counter-forming machine using heating and cooling methods.

Figure 6:
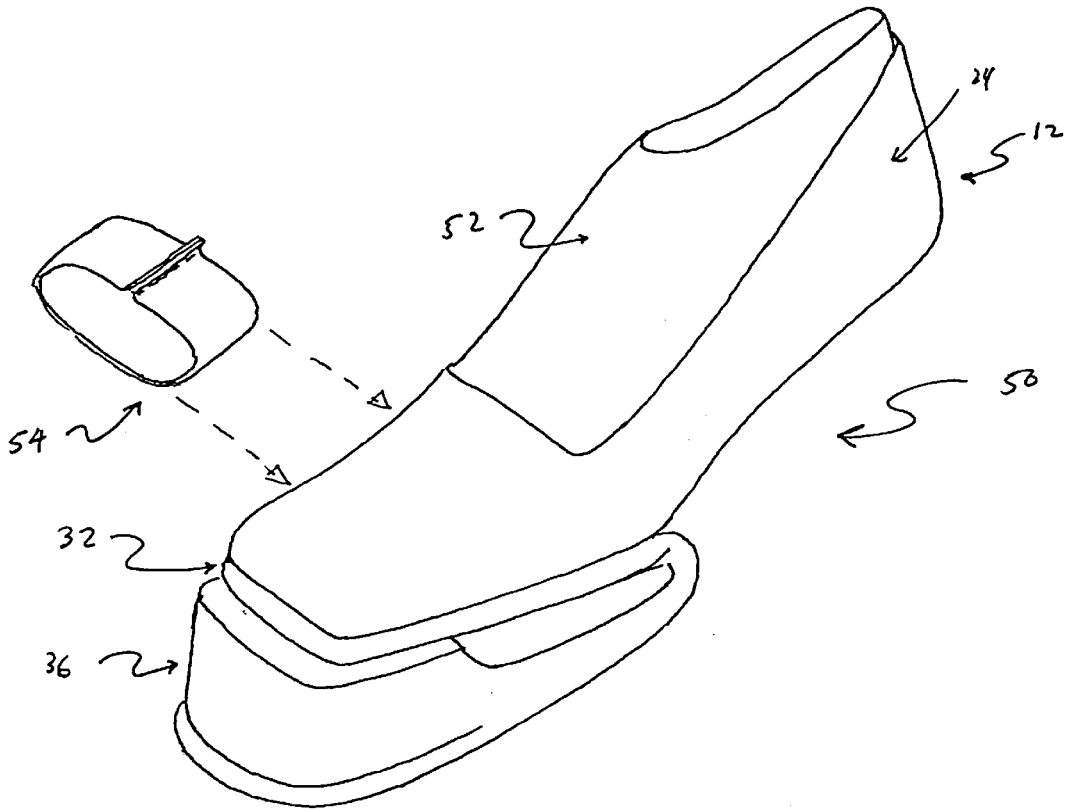
FIG. 6 shows the forepart of the outsole unit of FIG. 5 bent and to be held in place by an elastic retaining band.

Referring to FIG. 6, the tuckboard 16 as shown in FIG. 1 is stapled to the underside of a last 52, which is then inserted into the turned upper configuration 50 for tightly shaping the upper 12 over the contour of the last. The last 52, usually made of a piece of wood or synthetic material, roughly follows the shape of the foot.

The backpart 36 of the outsole unit 18 is bent to touch the forepart 32 and held in this position by an elastic retaining band 54. In his position, the back portion 24 of the upper 12 is lasted by hand or machine and the staples on the tuckboard 16 is removed. The upper 12 is passed through a heat setting machine to heat shrink the upper against the last 52. To promote good bonding with the outsole 28, the lasted back portion 24 of the upper is roughed appropriately.

Figure 7:
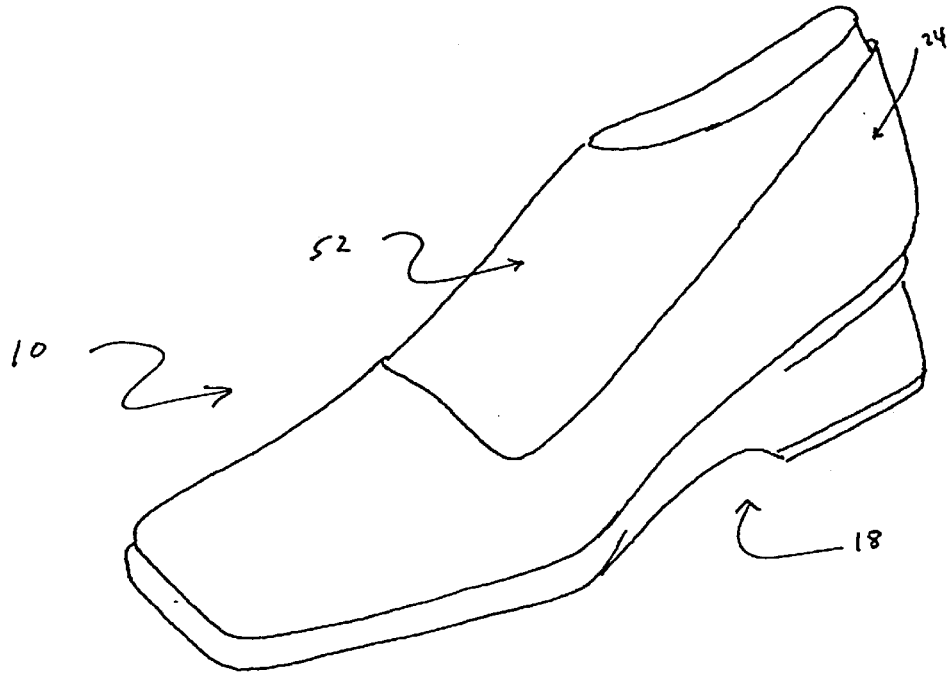
FIG. 7 shows the lasted back portion of the shoe attached to the backpart of the outsole unit of FIG. 6.

Referring to FIG. 7, the elastic retaining band 54 is removed and the outsole unit 18 is cemented to the lasted back portion 24. Finally, the last 52 is removed from the shoe 10 and the footbed 14 is inserted into the internal volume of the shoe.

Figure 8:
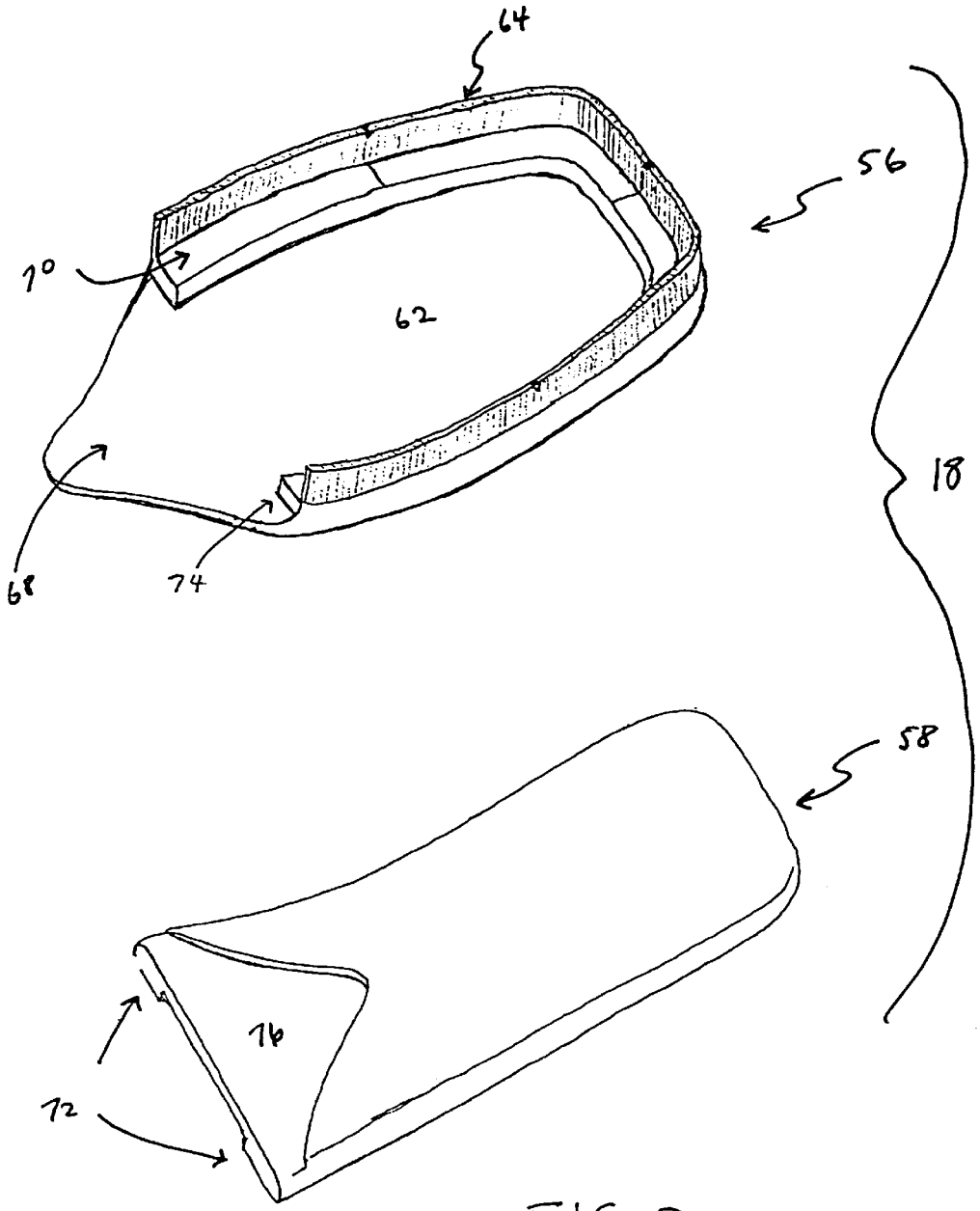
FIG. 8 shows an outsole with a separate forepart and backpart in accordance with another embodiment of the invention.

In the above embodiment, the outsole unit 18 is formed integrally. In another embodiment of the invention, the outsole unit 18 can be formed in two separate parts: a unit forepart 56 and a unit backpart 58. Referring to FIG. 8, the unit forepart 56 includes a bottom 62, which has a standing lip 64 disposed in a "U" shape around the periphery of the bottom and a raised base 70 internally hugging the standing lip. The bottom 62 has a protrusion 68 that extends beyond the top of the "U."

A brake 72 at the end of the unit backpart 58 is made to abut against a buttress 74 at the end of the raised base 70. When the brake 72 and the buttress 74 are in contact, the protrusion 68 of the unit forepart 56 fits into a channel 76, which is a depression formed on the unit backpart 58 and shaped to accommodate the protrusion. The unit backpart 58 is made of polyvinyl chloride or other material that is harder than the unit forepart 56. The unit backpart 58 can be formed integrally with or separately from a heel 60 (FIG. 11), which can be made of wood or another material such as acrylonitrile butadiene styrene resin.

A construction of the shoe 10 with the unit forepart 56 and the unit backpart 58 is described below.

Figure 9:
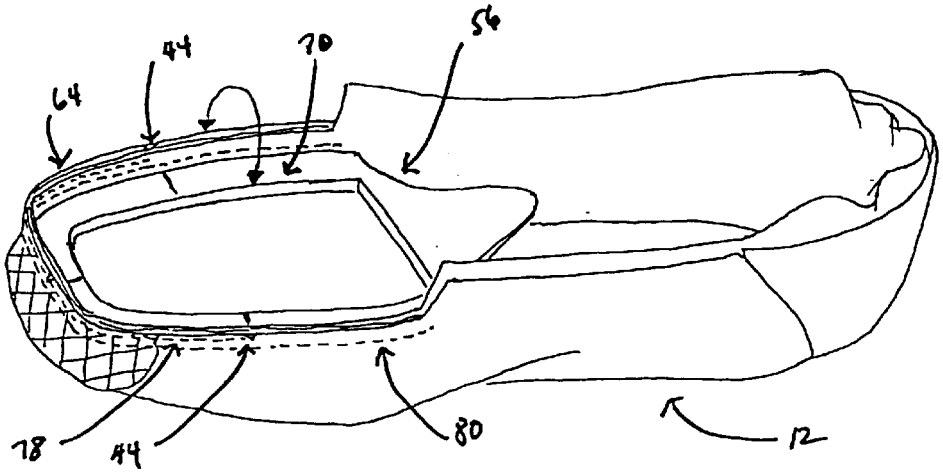
FIG. 9 shows the forepart of FIG. 8 being attached to the upper inside out.
Figure 9:
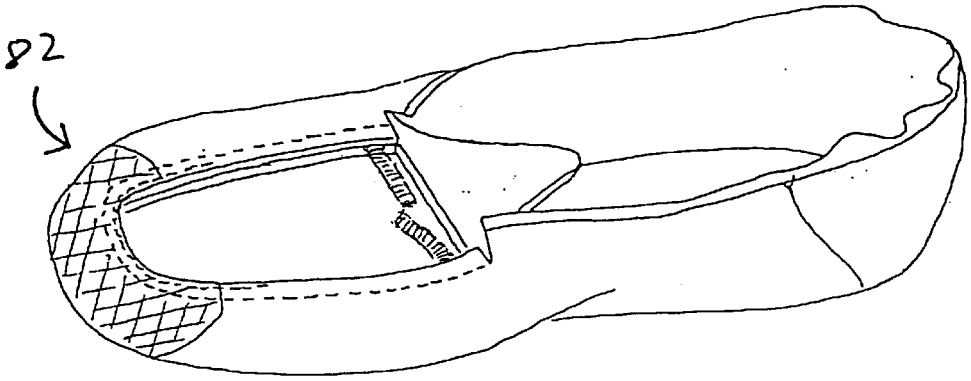

Referring to FIG. 9, the upper 12 is stitched to the standing lip 64 in an inside-out configuration. One row of stitching 78 is made from one side marker 44 to the other side marker 44, going around the periphery of the unit forepart 56. An additional row of stitching 80 is made from one lip end to the other lip end. Then the stitched lip 64 is folded and cemented to the raised base 70. The forepart 56 is then pressed to form a turned-in construction 82.

Figure 10:
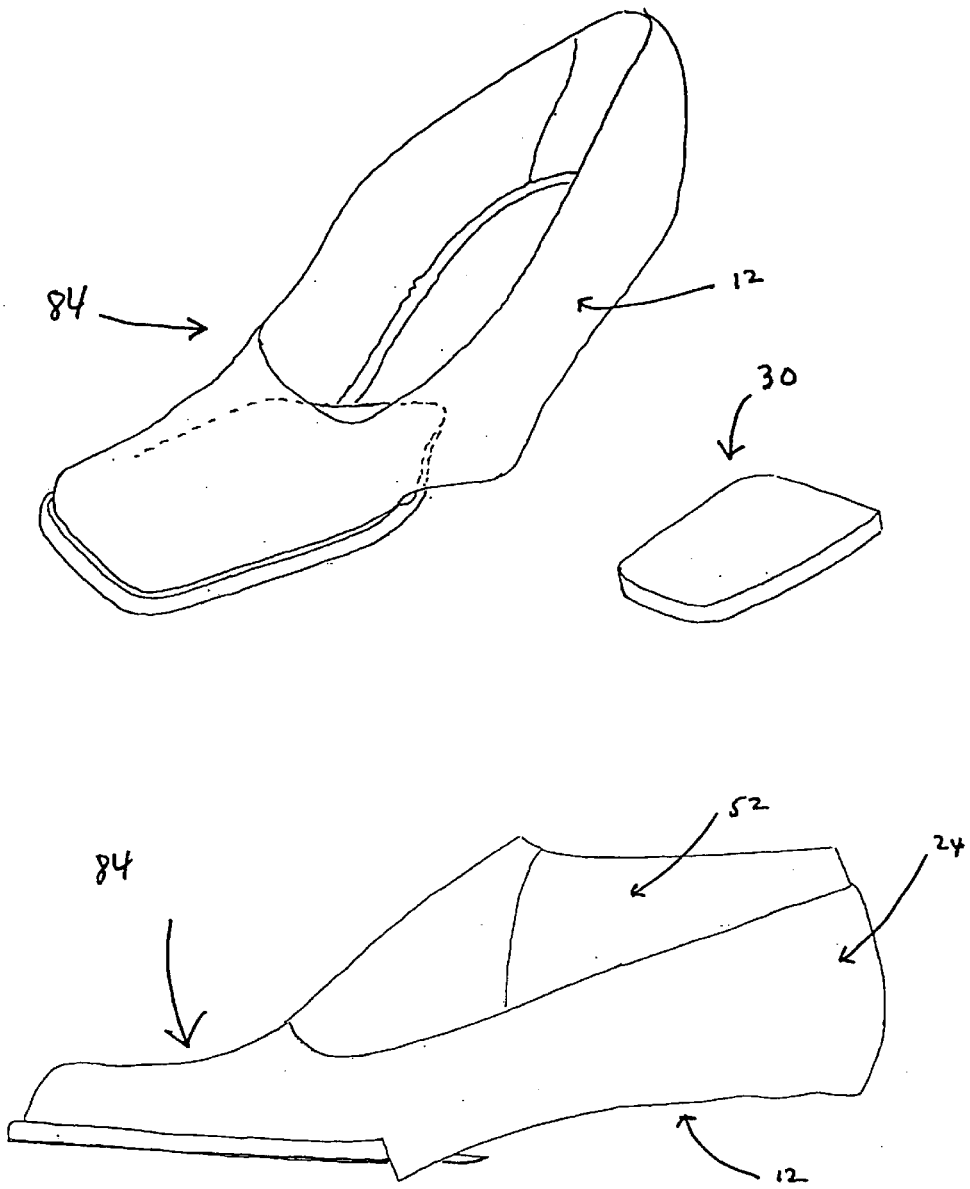

Referring to FIG. 10, the turned-in construction 82 is then turned inside in to form an upper turned-out construction 84 and the forepart filler 30 is inserted into the volume between the unit forepart 56 and the upper 12. A counter stiffener (not shown) and the tuckboard 16 (FIG. 1) are then inserted into the upper turned-out construction 84. The last 52 is then fitted into the volume between the upper 12 and the unit forepart 56. The back portion 24 of the upper 12 is pulled over the last 52.

Figure 11:
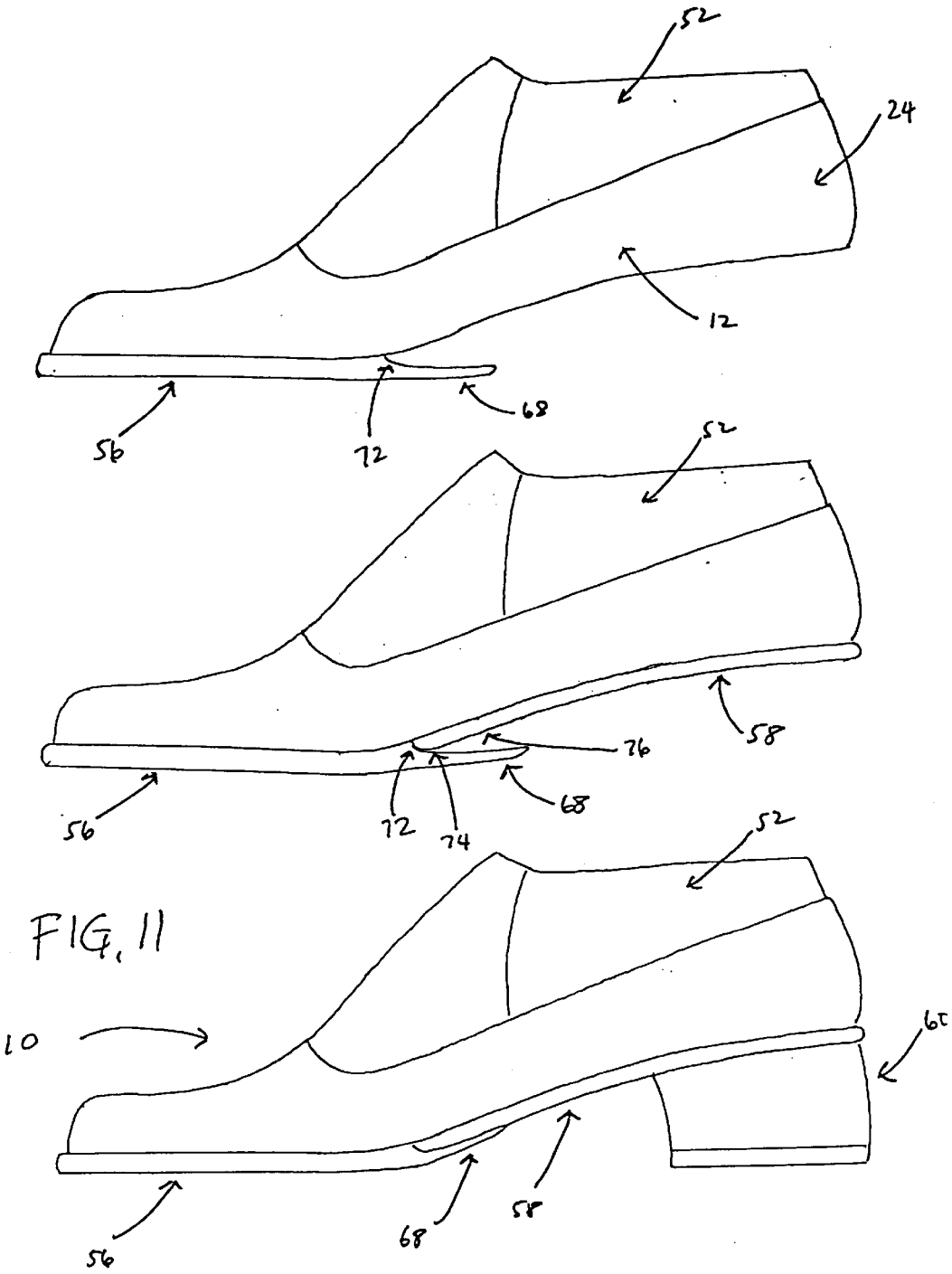
FIG. 11 shows the backpart being attached to the upper and the heel attached to the backpart.

Referring to FIG. 11, the back portion 24 is lasted to conform to the shape of the last 52 and roughed. The brake 74 of the unit backpart 58 is then abutted against the buttress 72 of the unit forepart 56 and the unit backpart 58 is cemented to the upper 12. The protrusion 68 is then attached to the channel 76 of the unit backpart 58. The heel 60 is attached to the bottom of the unit backpart 58. Finally, the last 52 is removed and the footbed 14 (FIG. 1) is inserted in the volume of the shoe 10.

Other embodiments are within the scope of the following claims.

What is claimed is:

1. A footwear comprising:

an outsole having a generally horizontal top surface, a fore area, and a rear area;

the fore area having a lip extending around a periphery of the fore area and being above the generally horizontal top surface;

the lip having an inner surface facing toward the generally horizontal top surface and an outer surface facing away from the top surface;

an upper having a toe part and a heel part, the toe part being in contact with the outer surface;

a stitch for securing the toe part to the outer surface of the lip;

the heel part being secured to a tuckboard; and the tuckboard being secured to the rear area.

2. The footwear according to claim 1, wherein the upper and the outsole are stitched at the periphery of the forepart, from one end of the lip to the other end, and stitched from a first marker at a side of a front portion of the upper to a second marker at the opposite side of the front portion of the upper.

3. The footwear of claim 1, further comprising:

a forepart filler inserted into a cavity defined by the lip of the forepart.

4. The footwear according to claim 1, wherein the allowance is about 7 mm.

5. The footwear according to claim 1, wherein said stitch is oriented in a generally horizontal manner.

* * * * *